US006841947B2

(12) United States Patent
Berg-johansen

(10) Patent No.: US 6,841,947 B2
(45) Date of Patent: Jan. 11, 2005

(54) SYSTEMS AND METHODS FOR CONTROLLING BRIGHTNESS OF AN AVIONICS DISPLAY

(75) Inventor: Roar Berg-johansen, Salem, OR (US)

(73) Assignee: Garmin AT, Inc., Salem, OR (US)

( * ) Notice: Subject to any disclaimer, the term of this patent is extended or adjusted under 35 U.S.C. 154(b) by 0 days.

(21) Appl. No.: 10/146,624

(22) Filed: May 14, 2002

(65) Prior Publication Data

US 2003/0214242 A1 Nov. 20, 2003

(51) Int. Cl.[7] ..... G09G 3/10; G05F 1/00; H05B 37/02

(52) U.S. Cl. ..... 315/169.3; 315/291; 315/307; 315/156; 315/157; 315/158

(58) Field of Search ..... 315/169.3, 156–158, 315/307, 247, 291, 30, 149, 150, 169.2, DIG. 4, 169.4, 219, 209 R, 312, 295; 345/102, 207, 204; 340/815.4, 784; 349/61, 64, 70; 379/21

(56) References Cited

U.S. PATENT DOCUMENTS

| | | | | | |
|---|---|---|---|---|---|
| 4,958,915 | A | | 9/1990 | Okada et al. | 350/345 |
| 5,019,808 | A | | 5/1991 | Prince et al. | 340/765 |
| 5,105,127 | A | | 4/1992 | Lavaud et al. | |
| 5,272,327 | A | | 12/1993 | Mitchell et al. | |
| 5,296,783 | A | | 3/1994 | Fischer | |
| 5,406,305 | A | | 4/1995 | Shimomura et al. | 345/102 |
| 5,428,265 | A | * | 6/1995 | Booth et al. | 315/158 |
| 5,719,474 | A | * | 2/1998 | Vitello | 315/307 |
| 5,724,062 | A | | 3/1998 | Hunter | |
| 5,783,909 | A | | 7/1998 | Hochstein | |
| 5,933,089 | A | | 8/1999 | Katada | 340/825.44 |
| 5,939,830 | A | | 8/1999 | Praiswater | |
| 6,081,073 | A | * | 6/2000 | Salam | 315/169.2 |
| 6,144,359 | A | | 11/2000 | Grave | |
| 6,215,680 | B1 | | 4/2001 | Rolston | |
| 6,281,640 | B1 | | 8/2001 | Kim | |
| 6,291,942 | B1 | | 9/2001 | Odagiri et al. | |
| 6,366,350 | B1 | | 4/2002 | Thornburg et al. | |
| 6,388,388 | B1 | * | 5/2002 | Weindorf et al. | 315/169.3 |
| 6,452,582 | B1 | | 9/2002 | Rolston | 345/102 |
| 6,590,561 | B1 | | 7/2003 | Kabel et al. | 345/102 |

(List continued on next page.)

FOREIGN PATENT DOCUMENTS

| | | |
|---|---|---|
| EP | 0 786 714 A2 | 7/1997 |
| EP | 0 786 714 A | 7/1997 |
| EP | 1 017 257 A1 | 7/2000 |
| EP | 1 204 088 A2 | 5/2002 |
| EP | 1 204 088 A | 5/2002 |

OTHER PUBLICATIONS

English Abstract of EP 0786714.

*Primary Examiner*—Don Wong
*Assistant Examiner*—Chuc Tran
(74) *Attorney, Agent, or Firm*—Devon A. Rolf

(57) ABSTRACT

The present invention provides for systems and methods for dimming a LED matrix functioning as a backlight to an avionics display. A system according to an embodiment of the present invention comprises a processor for receiving inputs of ambient lighting and temperature, as well as light generated by the LED matrix. The processor provides modulated pulse wave signals (square waves) to two control circuits for controlling the LED matrix in two modes. At low dimming levels, the processor modulates the duty cycle of a first square wave for affecting the light level and maintains a minimal duty cycle of a second square wave. Once the highest light level is obtained by increasing the duty cycle of the first square wave, the processor then modulates a second square wave by increasing its duty cycle. The duty cycle of the second square wave is modified by a circuit to produce a voltage level which is provided as an input to control light level of the LED matrix. As the duty cycle of the second signal is increased, so is the voltage level provided to the LED matrix and the light generated by the LED matrix.

17 Claims, 8 Drawing Sheets

U.S. PATENT DOCUMENTS

2001/0035848 A1 11/2001 Johnson et al. ..... 345/76
2002/0035848 A1 3/2002 Johnson et al.
2002/0130786 A1 * 9/2002 Weindorf ..... 340/815.45
2002/0135572 A1 * 9/2002 Weindorf ..... 345/204
2002/0140880 A1 * 10/2002 Weindorf et al. ..... 349/70

* cited by examiner

SYSTEMS AND METHODS FOR CONTROLLING BRIGHTNESS OF AN AVIONICS DISPLAY

FIELD OF THE INVENTION

The invention generally relates to controlling the brightness of an avionics display.

BACKGROUND OF THE INVENTION

Avionics displays provide critical flight information to aircraft pilots. It is expected that such displays are readable under a variety of lighting conditions. At one extreme, displays must be readable in fall daylight conditions as well as at the other extreme, in complete darkness. Sudden changes in the interior cockpit lighting conditions may occur, such as when the general cockpit lighting is turned on or off or when clouds block direct sunlight. An appropriate amount of backlight illumination is required to ensure consistent, readable avionics displays under a variety of changing lighting conditions.

Providing an appropriate amount of backlight requires a broad range of illumination. In dark ambient light conditions, low levels of backlight may be appropriate, such as 0.1 fL (foot Lamberts), whereas as in bright ambient light conditions, greater levels of light generation, such as 200 fL, are appropriate. Once the appropriate light level is determined, various factors may impact the amount of light actually generated.

One factor is temperature of the electrical components. Temperature variations of components can be caused by ambient cockpit temperature changes or heat generated during use of the electrical components. Backlight control units should compensate for changes in light levels due to temperature variations.

Age of the components is another factor impacting the amount of light generated by the backlight. Electrical characteristics of components gradually change over time, and consequently, the light produced by a backlight may gradually change. Backlight control units should account for changes in light levels due to age of the components.

In the past, fluorescent bulbs have been used to provide backlight to avionics displays along with various control units for dimming fluorescent bulbs. Such systems are disclosed in Patent Application U.S. Pat. Nos. 5,296,783 and 5,428,265. However, use of fluorescent bulbs for dimmable backlighting presents several undesirable characteristics. First, fluorescent bulbs have a finite life and are prone to sudden failures. The failure of a single bulb may render the display unreadable and replacing bulbs constitutes an unscheduled maintenance action which can adversely impact flight schedules. In addition, fluorescent bulbs are particularly temperature sensitive with regard to light generation as a function of their operating temperature, with a warm fluorescent bulb generating more light than the same bulb colder. Finally, fluorescent bulbs require high alternating voltage levels for operation. This is undesirable for several reasons, a few of which are as follows. First, a high voltage requires a dedicated high voltage power source adding to the complexity and weight of the airplane. Second, high voltages increase the risk of sparks due to malfunctions, such as a short circuit, presenting a potential danger. Third, electrical circuitry controlling high voltage is prone to high frequency signal generation (i.e., electrical 'noise') which can interfere with the operation of other electrical aircraft systems.

Thus, there is a need for a flexible control unit providing a wide dimming range of light generated in a backlight for an avionics display without requiring high voltages, providing reliable light generation, and that is less sensitive to temperature changes.

SUMMARY OF THE INVENTION

The present invention provides for systems and methods for dimming a Light-Emitting-Diode (LED) matrix functioning as a backlight to an avionics display. A control unit receives inputs, for example, including signals indicating light levels generated by a backlight, and calculates appropriate output signals that are provided to a display unit comprising a plurality of LEDs allowing a wide range of dimming. A plurality of LEDs provide redundant light sources such that the failure of a single LED does not adversely effect readability of the avionics display.

In accordance with an aspect of the present invention, a system for controlling the brightness of an avionics display comprises a processor that receives inputs of lighting conditions, temperature, and light generated by an LED matrix providing backlighting. The processor provides modulated pulse wave signals to two control circuits for controlling the LED matrix in two modes. At low dimming levels, the processor modulates the duty cycle of a first square wave to affect light levels while maintaining a maximum duty cycle of a second square wave. Once the highest light level is obtained by increasing the duty cycle of the first square wave, the processor then maintains the duty cycle of the first wave and modulates a second square wave by decreasing its duty cycle. The duty cycle of the second square wave is converted by a control circuit to a voltage level inversely related to the duty cycle. The control voltage level is provided as a control signal to the LED matrix. As the duty cycle of the second signal is decreased, the control voltage level is increased and so is the light generated by the LED matrix.

In one embodiment of the invention, a system for controlling the brightness of an avionics display comprises a processor providing first and second digital control signals, a pulse width modulator control circuit receiving one digital control signal and providing a pulse width modulated control signal with a duty cycle related to the input digital control signal, a current control voltage circuit receiving the second digital control signal and providing a current control voltage signal, an LED matrix receiving the pulse width modulated control signal and current control voltage signal, and a sensor sensing the light generated by the LED matrix and providing an input signal to the processor.

In another embodiment of the invention, a method for controlling the brightness of an avionics display comprises providing a current control voltage signal and a pulse width modulated control signal to an LED matrix, sensing the light generated by at least one of the LEDs on the LED matrix, and altering the current control voltage signal or pulse width modulated control signal to the LED matrix until the light generated by the LED matrix is at the desired level.

In another embodiment of the invention, an apparatus for controlling the brightness of an LED matrix comprises a processor receiving an input signal and providing a first and second digital signal, a pulse width modulator controller for receiving first digital signal and modulating the duty cycle of a modulated pulse wave control signal, a current controller for receiving the second digital signal and modulating a current control voltage, and an LED for receiving the pulse width modulated control signal and current control voltage signal.

In another embodiment of the invention, an apparatus for controlling the brightness of an LED matrix comprises a power supply providing power to an LED matrix, a processor receiving an input signal corresponding to the light generated by at least one of the LEDs in the LED matrix and providing a brightness control signal to the LED matrix, and a LED matrix wherein the LED matrix is comprised of a planar array of LEDs on a board with at least one LED affixed to one side of the board, and the rest of the LEDs affixed to the other side of the board.

BRIEF DESCRIPTION OF THE DRAWINGS

Figure 1A:
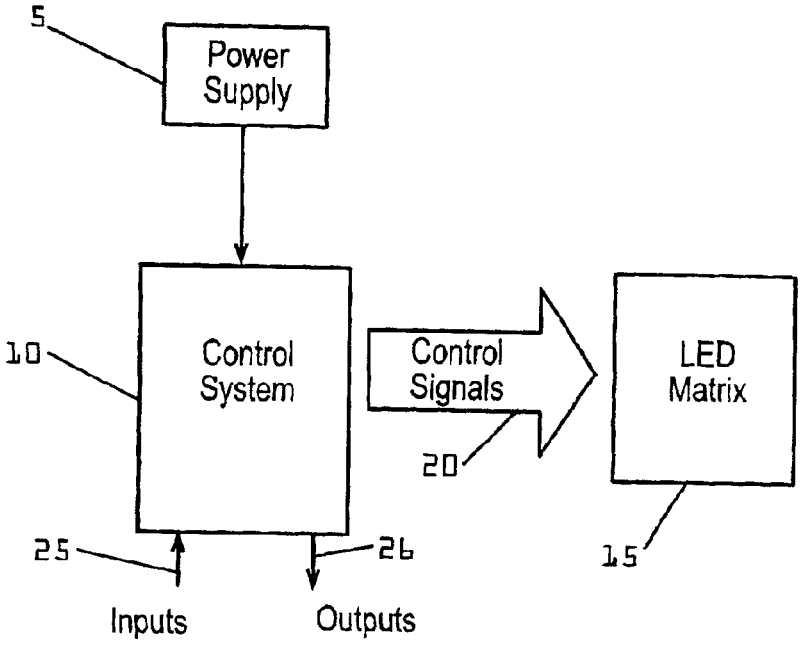

Having thus described the invention in general terms, reference will now be made to the accompanying drawings, which are not necessarily drawn to scale, and wherein:

FIG. 1A is a functional block diagram of a control unit in accordance with an embodiment of the invention.

Figure 1B:
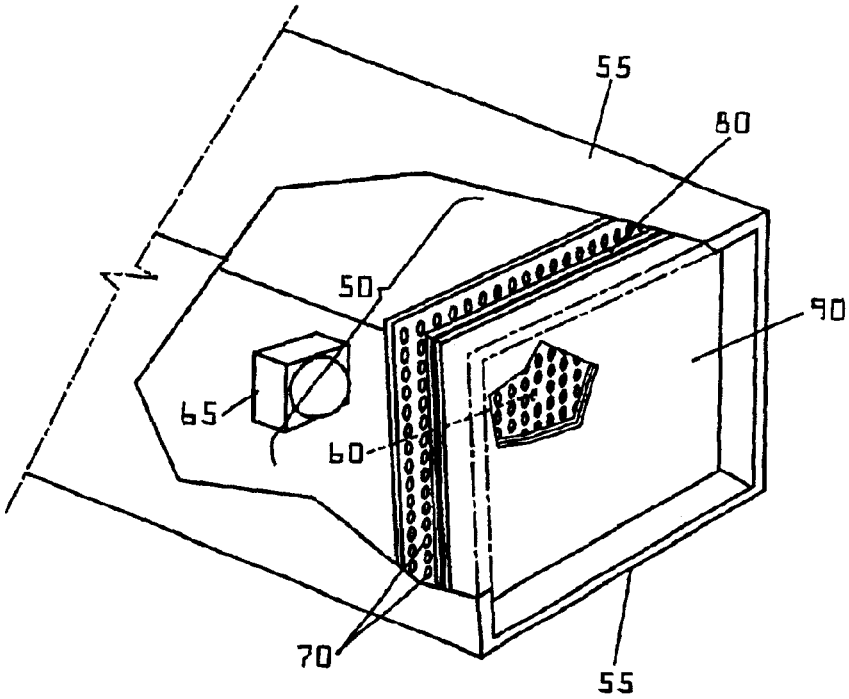
Figure 11:
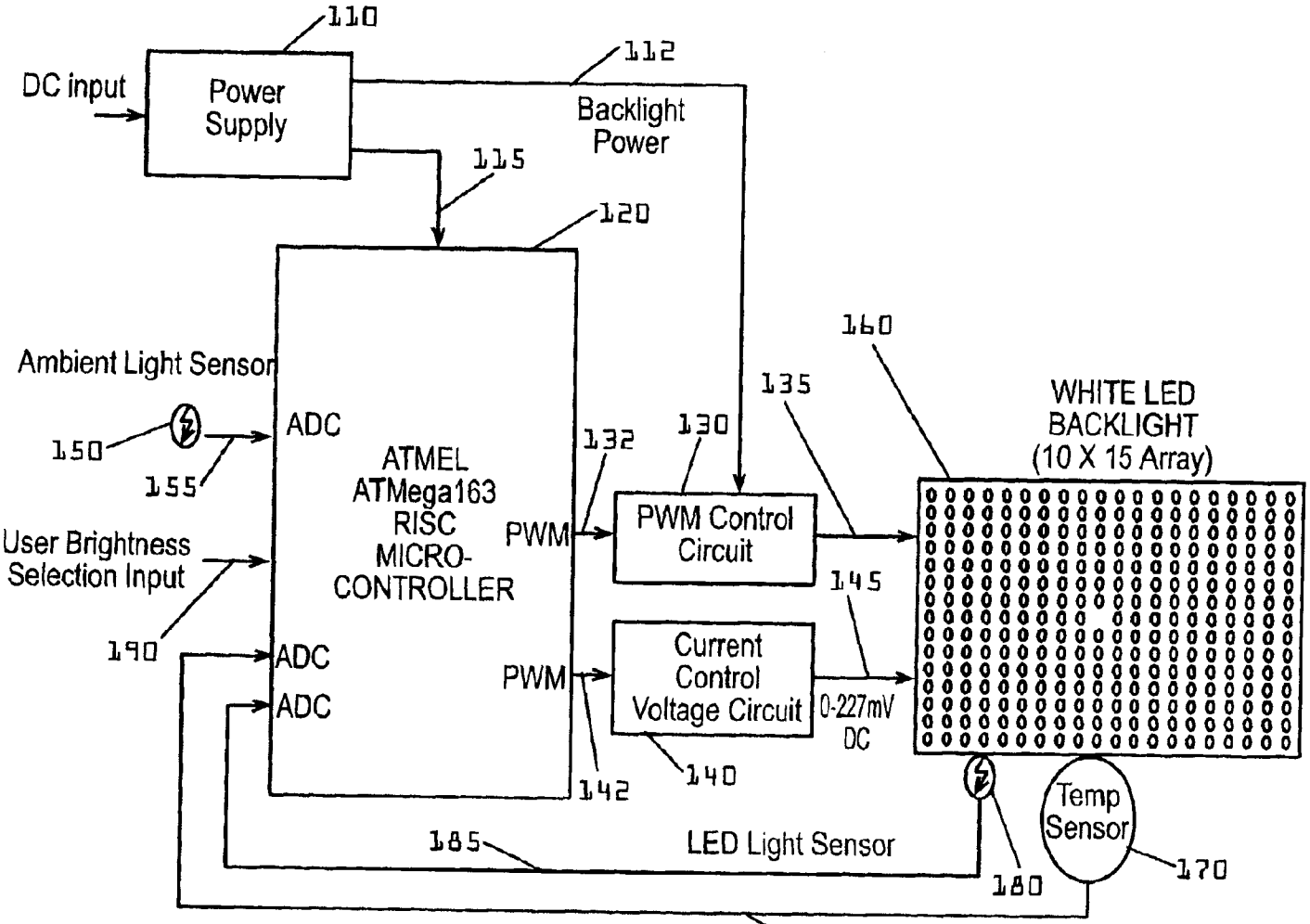

FIG. 1B is a sectional view of a display incorporating a dimmable backlight LED matrix in accordance with an embodiment of the invention.

FIG. 1C is a functional block diagram of a dual mode LED backlight control unit in accordance with an embodiment of the invention.

FIG. 2 is a diagram of the Pulse Width Modulated (PWM) Control circuit in accordance with an embodiment of the invention.

FIG. 3 is a diagram of the Current Control Voltage circuit in accordance with an embodiment of the invention.

Figure 4:
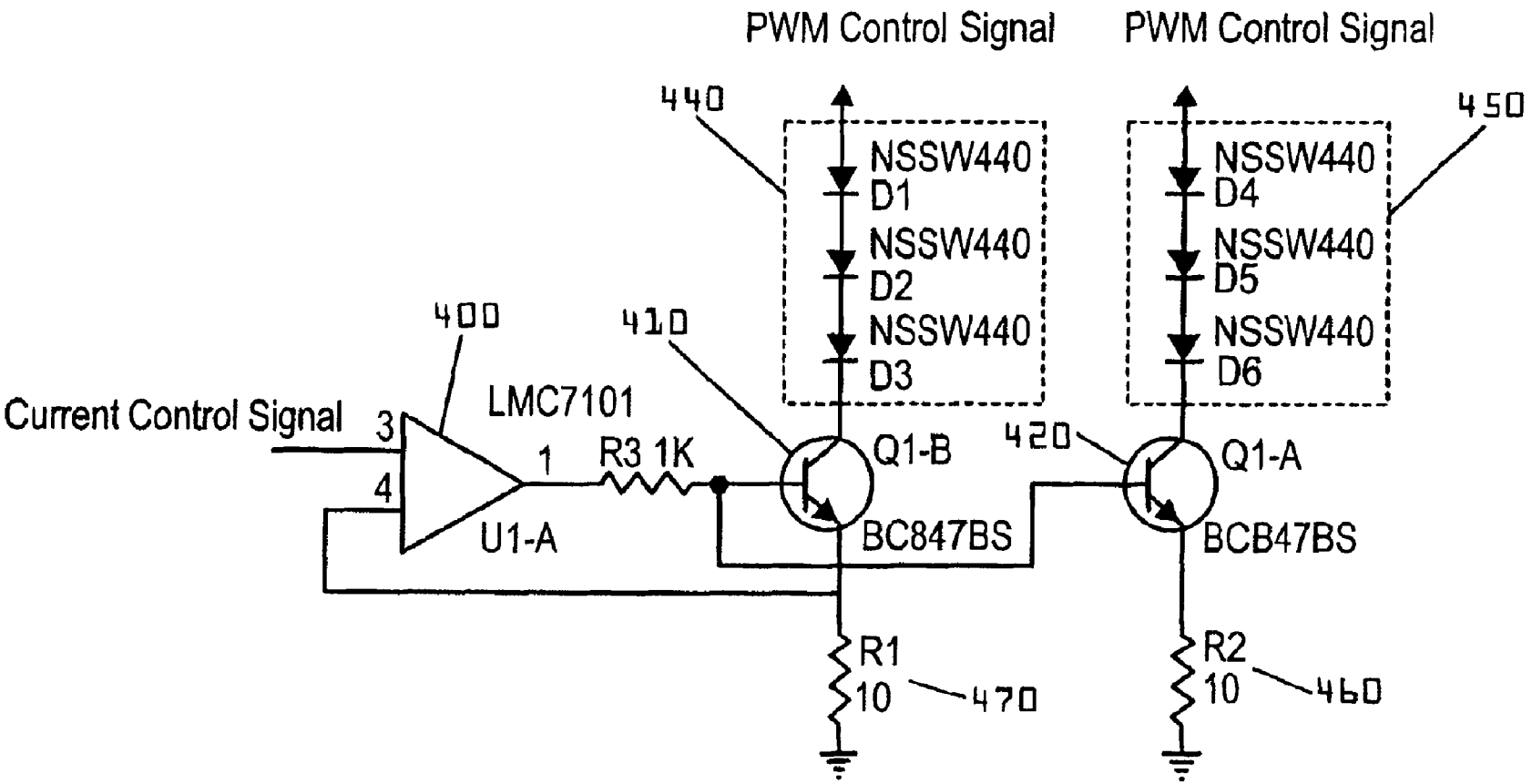

FIG. 4 is a diagram of the LED Driver circuit suitable for use in connection with the present invention.

Figure 5:
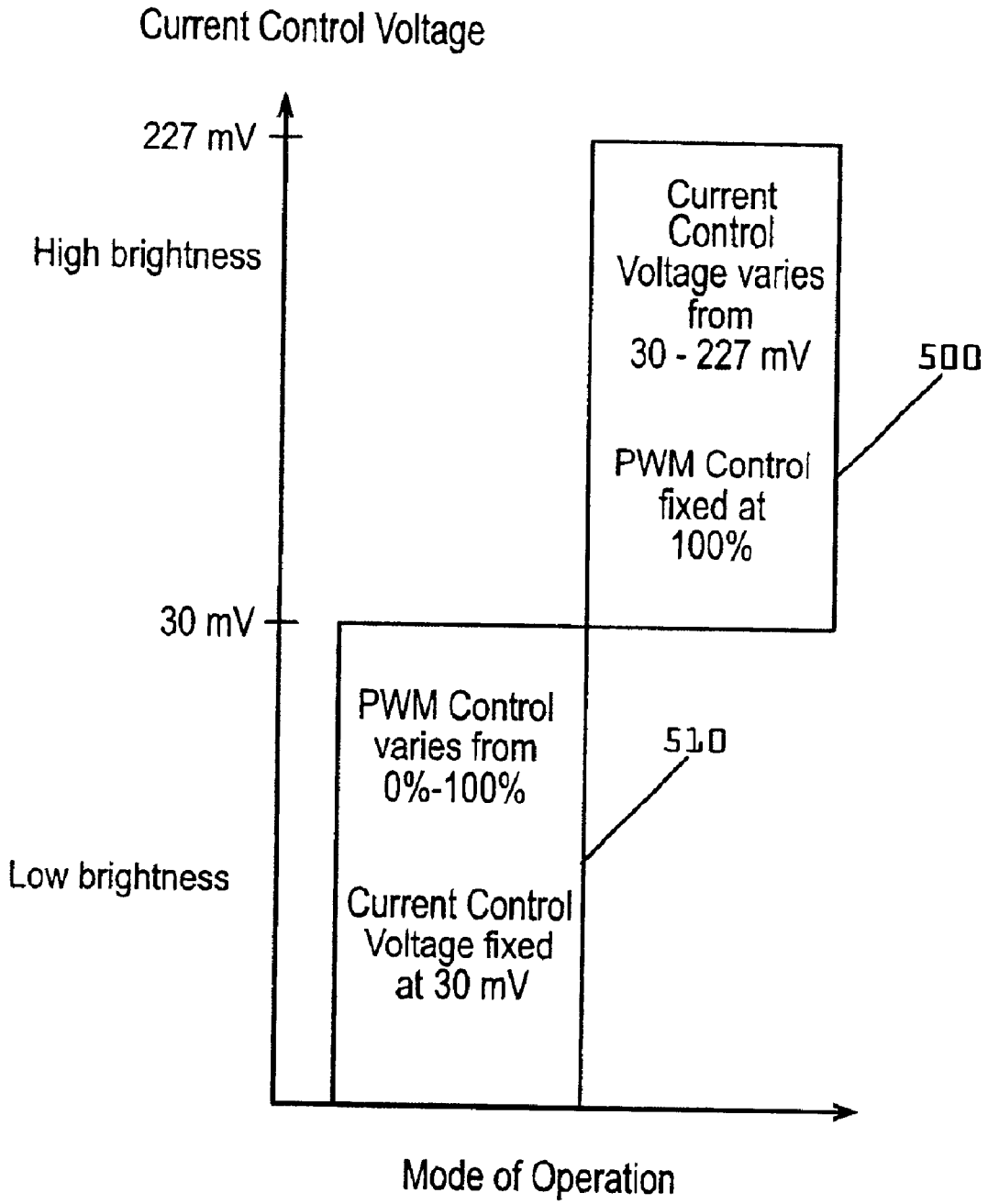

FIG. 5 is a diagram of the relationship of the operation of the dual modes with respect to the duty cycle of the pulse wide modulated control signal, the current control voltage signal, and the brightness level in accordance with an embodiment of the invention.

Figure 6:
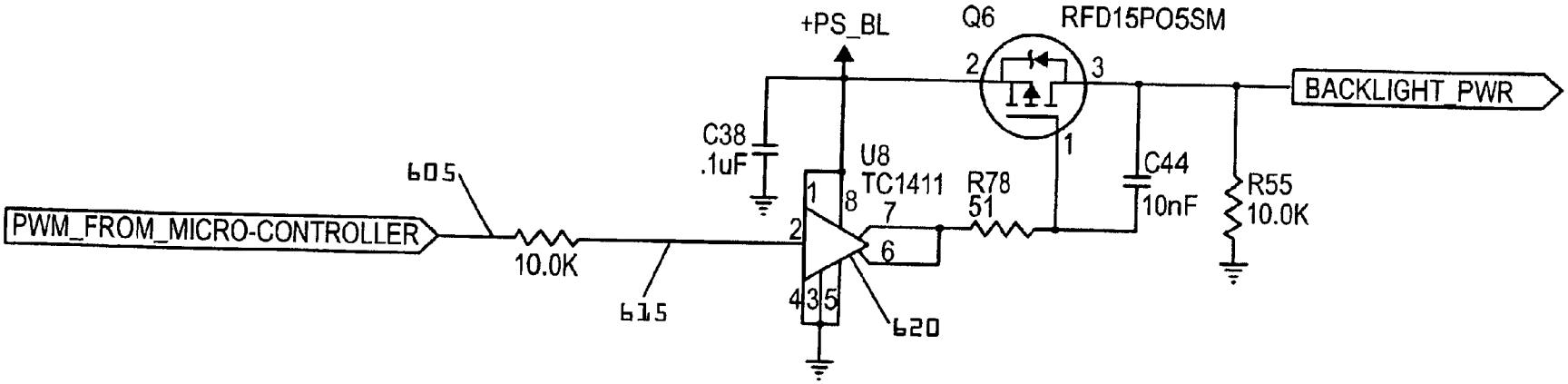
Figure 7:
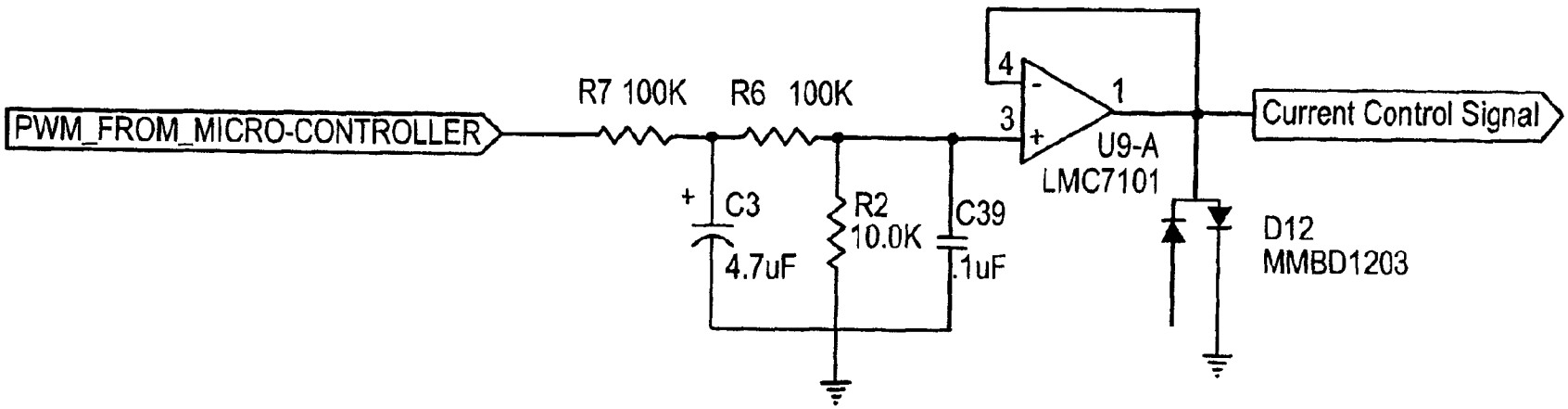

FIG. 6 is a diagram of the Pulse Width Modulated (PWM) Control circuit in accordance with an alternative embodiment of the invention.

Figure 7:
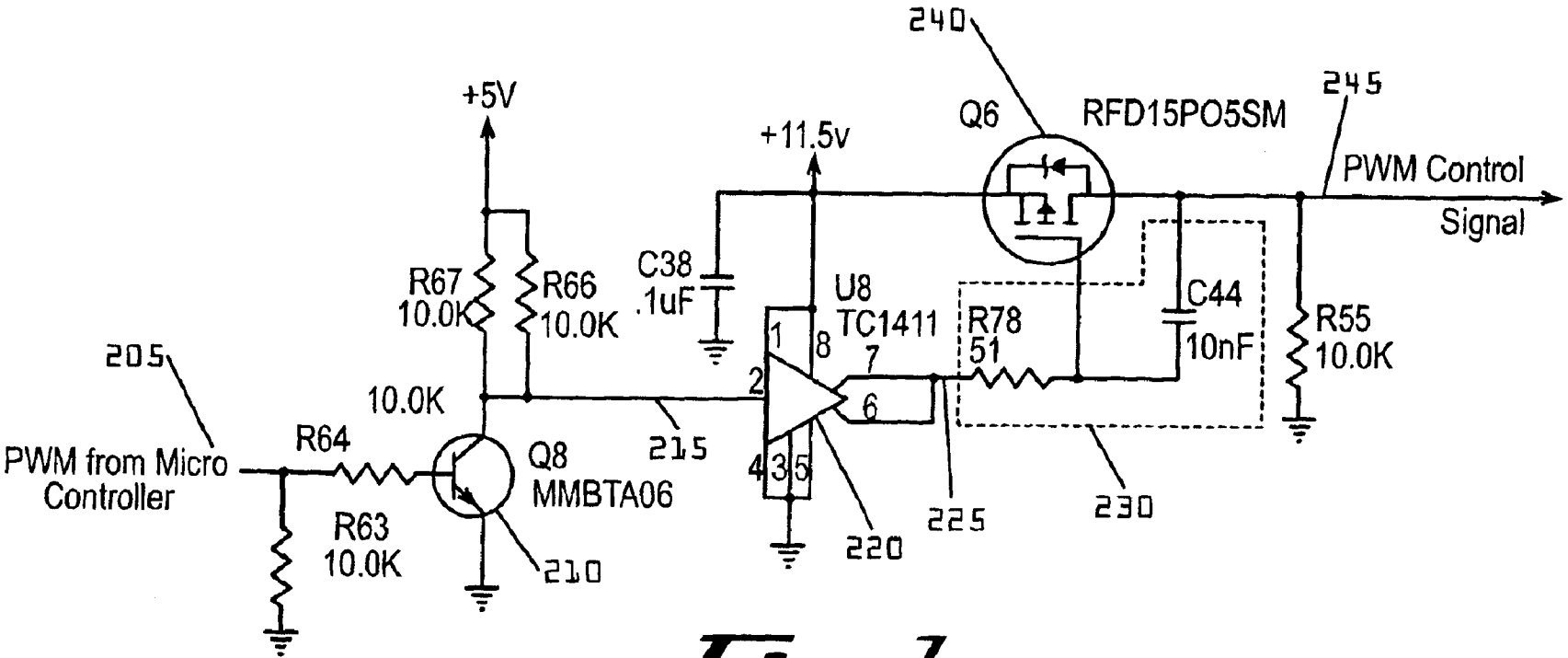
Figure 7:
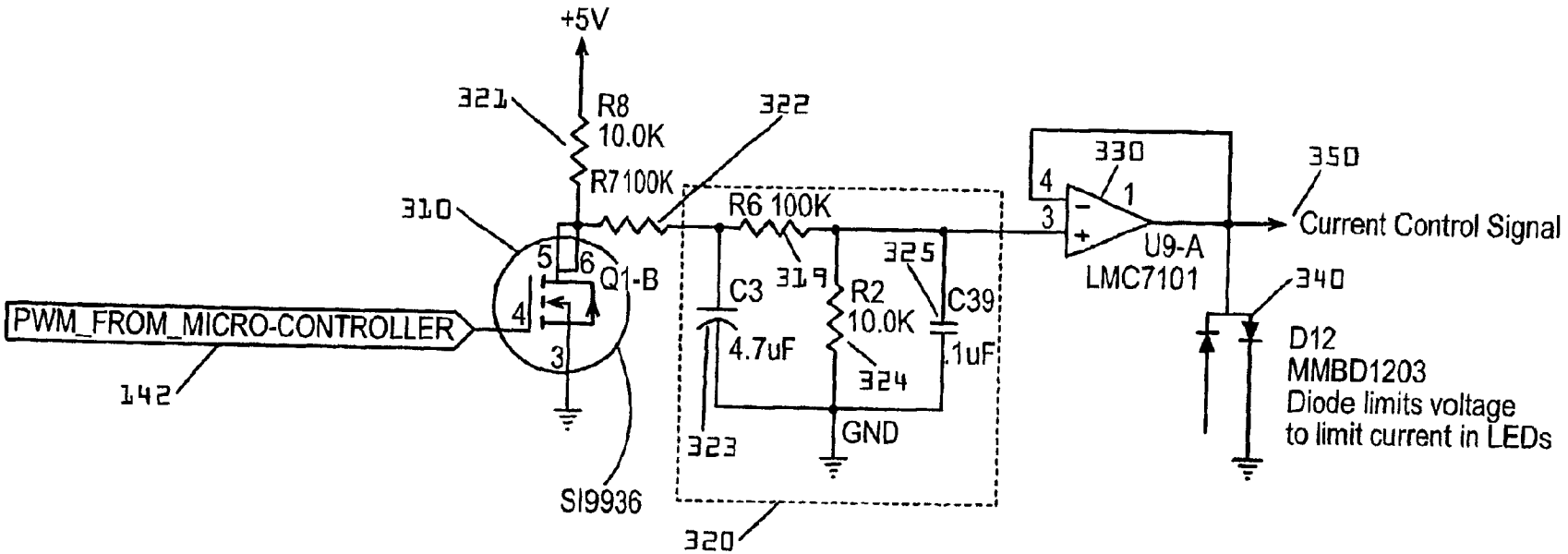

FIG. 7 is a diagram of the Current Control Voltage circuit in accordance with an alternative embodiment of the invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided for thoroughness and completeness, and fully convey the scope of the invention to those skilled in the art. Like numbers refer to like elements throughout.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

System Overview

In the illustrated embodiment disclosed herein, the invention controls the light level generated by a plurality of LEDs. In this embodiment, the LEDs comprise white-colored emitting LEDs arranged in a planar matrix functioning as a backlight for an instrument display, such as an LCD display. The LCD is translucent and some of the light generated by the LED matrix behind the LCD display passes through the LCD display, illuminating the display. Such display arrangements may be used in avionics or vehicular applications requiring varying backlight levels. In another embodiment, the plurality of LEDs are arranged in a planar matrix with the LED matrix functioning as the display itself. Such an LED matrix could be used to display letters, words or other graphical indicia. The LEDs may be of a color other than white for easier readability. In either application, a control unit senses ambient conditions, such as light and temperature, as well as light generated by the LED matrix, and adjusts one of two input signals to the LED matrix providing appropriate light levels to the display.

In accordance with an aspect of the invention, dimming of the display is accomplished by using one of two modes of operation. In each mode, dimming occurs by holding constant one input to the LED matrix while varying the other input to the LED matrix. One of the inputs to the LED matrix is called the Current Control Voltage signal, controlling the current flowing through the LED matrix based on its voltage level. The other input is a pulse width modulated (PWM) signal, called the PWM Control signal, controlling the power to the LED matrix. These two signals are provided to the LED matrix from two circuits, called the PWM Control Circuit and the Current Control Voltage Circuit. A processor provides inputs to each of these circuits. Although each circuit receives a PWM wave input provided by the processor, the two signals are independent of each other. Specifically, the processor can vary one PWM signal without varying the other. Furthermore, although the illustrative embodiment varies the light levels by altering only one signal, the system could also alter both signals simultaneously.

FIG. 1A shows the functional components of an LED backlight dimming system in accordance with one embodiment of the present invention. A power supply 5 provides a DC voltage to the control unit 10 and the LED matrix 15. The control unit 10 provides control signals 20 affecting the amount of light generated by the LED matrix 15. In determining the proper level of light that the LED matrix should provide, the control unit 10 receives various inputs 25 that are processed. The inputs 25 sense various ambient environmental conditions, such as light, temperature, or may indicate status of equipment such as cooling fan operations etc. The control unit 10 may also have outputs 26 controlling other components, such as activating a cooling fan, indicating abnormal system operation, report excessive temperature readings, writing time usage in a log, reporting unusual events in a maintenance log, et cetera. The control unit 10 may implement other system functions or coordinate operation with other processors.

FIG. 1B shows an illustrative embodiment of a display incorporating an LED matrix as a backlight. Typically, the LED components are affixed in a structure, shown as a housing 55. The components include the LED matrix 50, a diffuser 80, and an LCD display 90. In the exemplary embodiment, the backlight LED matrix is comprised of individual white-color LEDs 70 arranged in 20 rows by 15 columns, affixed to a circuit board, although other embodiments may utilize other colors or matrix configurations can be used. The LED matrix is positioned about one inch behind the diffuser 80. At this distance, the light generated by the individual LEDs has scattered and the diffuser 80 scatters the light further. This arrangement minimizes 'point' sources of light behind the LCD display and ensures a consistent, even backlight is provided to the LCD display 90. The LED matrix 50 has one or more one or more reverse LEDs 60 affixed to the circuit board 63. The purpose is to generate light detected by a light sensor 65. If the light sensor 65 were placed between the LED matrix 50 and the diffuser 80, the sensor would detect not only the light generated by the LED matrix, but also ambient light entering from the exterior of the structure 55 through the LCD display 90 past the diffuser 80. Placement of the sensor in an enclosed cavity behind the backlight LED matrix 50 ensures no ambient light is detected by the light sensor 65. While the sensor does not directly measure the light produced by the LEDs 70 backlighting the LCD, the amount of light generated by the reverse LED 60 will be proportional to the backlight to the LCD. The light level for the single LED is assumed to behave similar to other LEDs as the components age or vary in temperature. The system is calibrated at the time of manufacturing to determine how the light sensor levels correlates with the light actually produced by the LED matrix.

FIG. 1C shows an illustrative embodiment of the LED matrix control unit using a dual mode controller in accordance with the present invention. A power supply 110 provides the necessary DC power to the components. In the illustrative embodiment shown in FIG. 1C, the power supply provides a +5 volt supply to the processor 120 via a connection 115. A +11.5 volt supply is provided to the PWM Control Circuit 130 via another connection 112 which is switched by the circuitry 130 for forming the PWM Control signal 135. Although not shown, the power supply provides appropriate power to the components of the PWM Control Circuit 130 and Current Control Voltage Circuitry 140 shown in FIGS. 2 and 3 respectively. Those skilled in the art will appreciate that other functionally equivalent components may be used requiring different voltage levels. However, the power levels shown here are readily available in an aircraft cockpit, minimizing the likelihood of sparking and high frequency signal noise.

A processor 120 provides the inputs to the PWM Control circuit 130 and Current Control Voltage circuit 140. The outputs of these two circuits are connected to the LED matrix 160 and control the light generated by the LED matrix. In order to effectively control the LED matrix 160 under various operating conditions, the processor receives various inputs. These inputs can include, but are not limited to, analog signals from an LED light sensor 180, ambient temperature sensor 170, ambient light sensor 150, and manual brightness control input 190. The ambient light sensor 150 is deployed such that it senses the ambient light conditions of the environment in which the display is functioning, i.e., an aircraft cockpit. The sensor 150 detects light levels ranging from fall daylight to complete darkness. The processor receives an analog input from an temperature sensor 170 indicating the backlight temperature. The temperature sensor can be affixed to the LED matrix itself, a heat sink which is affixed to the LED matrix, or in the proximity of the LED backlight such as mounted internal to the unit housing the LED backlight. Any of these methods provides an input to the processor regarding the temperature of the backlight and/or its ambient temperature. The temperature sensor may be used by the processor for adjusting output signals in controlling the LED light level, but can also serve as a system warning of potential dangers due to excessive temperature, recorded in a maintenance log noting environmental operating conditions, used to activate cooling fans, etc. Finally, the processor may receive a manual brightness control input 190 overriding the automatic brightness level determination by the system.

The processor 120 shown may be one of a variety of commercial microprocessors, such as the ATMEL ATMega 163 RISC based micro controller. This micro controller incorporates standard microprocessor functions such a processor, memory, cache, and input/output capabilities, along with ancillary functions, such as analog-to-digital converters and square wave generators. In the illustrated embodiment, the processor 120 receives the analog inputs from the ambient light sensor 150, LED light sensor 180, temperature sensor 170, and manual brightness control input 190 and converts these signals to digital values available for processing by the software controlling the processor. In this embodiment the processor incorporates analog-to-digital circuitry and those skilled in the art appreciate alternative implementations may use analog-to-digital circuitry external to the processor 120 for converting the analog signals to digital signals.

Processor 120 provides signals to the PWM Control circuit 130 and Current Control Voltage circuit 140 via respective connections 132 and 142. The output signals are independently controllable pulse width modulated (PWM) signals. A PWM signal is a square wave of a given frequency and characterized by a signal that is repeatedly 'on' and 'off' within a periodic time. The PWM signal could be generated using external circuitry using components well known to those skilled in the art. However, the ATMEL ATMega 163 RISC based processor 120 incorporates functionality for generating square waves of a given frequency and duty cycle. The frequency denotes the time period in which the waveform repeats. The duty cycle describes the relative 'on' time and 'off' time of the square waves during a single time period. The ratio of the 'on' time to the 'off' time is expressed as the 'duty cycle' of the square wave. For example, a duty cycle of 50% corresponds a signal where the 'on' time is one half of the total time period regardless of the frequency.

The software executed by the processor 120 controlling the LED matrix writes a value into a special purpose register which the processor uses to generate a square wave with a duty cycle corresponding to the value based on a predetermined formula. The value can be in a range defined by the software and the illustrative embodiment defines a range of 0–1023 providing 1024 different duty cycles. The duty cycle corresponding to a value X written to the register is defined by the formula below:

$$\text{Duty Cycle}=(X/1023)*100\%$$

Thus, a value of 511 results in a duty cycle of about 50% resulting in a square wave that is 'on' the same amount of time it is 'off' in a given period. There are two values of X that result in special cases of a square wave. A value of X=0 results in a 0% duty cycle, which is a signal in the 'off' level for the entire period. A value of X=1023 corresponds to a 100% duty cycle which is a signal in the 'on' level for the entire period. Those skilled in the art appreciate that separate circuitry for generating variable pulse waves may be used.

Two separate PWM signals are generated by the processor 120. The signals serve as inputs to the PWM Control circuit 130 and Current Control Voltage circuit 140 respectively and each corresponds to one of the dual modes of control. While alternative embodiments may incorporate only one of the modes described herein, the use of both modes provides additional flexibility in controlling the LED matrix light levels. The PWM Control circuit 130 accepts the PWM signal as an input 132 and generates an output, the PWM Control signal, that largely 'follows' the duty cycle of the input signal. Thus, the output of PWM Control circuit 130 is largely a square wave, but the PWM control circuit 130 incorporates an RC circuit to slow the rise and fall times of the modulated signal. The output of PWM Control circuit 130 provided to the LED Matrix 160 controls the backlight in a first mode of operation.

A PWM signal is also present on output 142 of the processor and is input to the Current Control Voltage circuit 140. The Current Control Voltage circuit 140 maps the PWM signal to a DC output voltage, the Current Control Voltage signal. The DC voltage signal present at the output connection 145 is inversely correlated to the duty cycle of the PWM signal at the input connection 142. A PWM signal 142 with a 0% duty cycle will result in a 'high' DC voltage, which has a maximum value of 227 mV in the illustrative embodiment (see FIG. 5). Similarly, a PWM signal 142 with a 50% duty cycle will result in a DC voltage of about 114 mV, and a PWM signal with a 100% duty cycle will result in a DC voltage of 0 mV. The DC voltage signal present at the output connection 145 is provided to the LED Matrix 160 where it controls the LED current in the LED matrix. This signal is used in a second mode for controlling the brightness of the backlight. As discussed subsequently, the software operating in the processor may limit the range of the PWM duty cycle to less than 100% so as to limit the lower range of the DC voltage to be no lower than 30 mV.

The other input received by the LED matrix is the Current Control Voltage signal which is a variable DC voltage output from the Current Control circuit 140. The output signal of the Current Control Voltage circuit is inversely related to the duty cycle of the input signal and the resulting output voltage varies from 0 to 227 mV. The voltage level controls the current that flows through the LEDs. The lower the voltage, the lower the current, and the less light generated by the LED matrix. The LED current is based on the following formula:

$$LED\ \text{current}=(LED\ \text{control voltage}(mV)/10)mA$$

Thus, an LED control voltage of 227 mV produces 22.7 mA of current in the LED. By decreasing the control voltage, the LED current decreases, and results in a corresponding decrease in light. The maximum light is produced when the current is at the maximum 22.7 mA.

In the illustrative embodiment, the LED matrix is a white-colored LED backlight assembly comprising a planar array of 20 rows by 15 columns of LEDs, although other size arrangements may be used without deviating from the spirit of the present invention.

The LED matrix is proximate in location to two sensors, the LED light sensor 180 and temperature sensor 170. The LED light sensor 180 senses the amount of light generated by the reverse mounted LEDs which is used to indicate the amount light generated by the LED matrix 160. The temperature sensor 170 is used to monitor the backlight temperature.

PWM Control Circuit

FIG. 2 depicts an illustrative PWM Control circuit in accordance with the present invention. The circuit accepts a PWM signal from output 132 from the processor and provides a PWM Control signal with a similar duty cycle to input 135 of the LED matrix. In the present embodiment, there are 1024 discrete duty cycles that can be indicated at input 135. The PWM signal is received as input to transistor 210 which is turned on or off based on the PWM signal level. If the input 205 to transistor 210 is low, then the output signal 215 of the transistor is high. Thus, the output of transistor 210 is an inverted version of the input signal. Output signal 215 is presented to the input of FET driver 220 and its output 225 follows the input signal 215. The output 225 in turn provides the input to the MOSFET transistor 240 which inverts the signal at output 245. Thus, a high level signal to MOSFET 240 results in a low level signal 245. The output signal 245 serves as input 135 to the LED Matrix. As the input signal to circuit 130 is inverted twice within PWM Control circuitry 130, the output of circuit 130 tracks the input signal.

The PWM Control circuit incorporates an RC network 230 slowing the rise and fall time of the PWM Control signal 245. This modified PWM signal is provided as input to the LED matrix. As shown in FIG. 4, the LED matrix comprises operational amplifiers for controlling the current to the LEDs. An input signal with too rapid of a rise or fall time may cause the operational amplifiers to malfunction. Thus, the RC circuit 230 avoids such malfunctions.

The pulse width modulated signal provided by the PWM Control circuit 130 modulates the power to the LED matrix 160 affecting the light generated by the LEDs. While the duty cycle may vary, the signal frequency is fixed. The selected frequency is designed to minimize interference with the LCD display. The display has a fixed vertical synchronous refresh frequency of 60 HZ in the illustrative embodiment and it is desirable to avoid PWM Control signals that are close to the refresh frequency, or harmonics thereof. If the PWM frequency is close to the refresh frequency or a harmonic thereof, a 'beat frequency' occurs. The 'beat frequency' is the difference between the rate of the two signals and may cause interference with the display manifesting itself as a flicker in the display. To minimize visual interference, the PWM frequency is set to a harmonic plus one-half of the refresh frequency. One half of the refresh frequency is 30 HZ. In the illustrative embodiment, this is added to the second harmonic frequency of the display which is (60 Hz*2)=120 Hz to yield a frequency of 120+30 Hz=150 Hz. A PWM Control signal of 150 Hz minimizes the interference with the second or third harmonic of the display refresh frequency by maximizing the 'beat frequency.' The higher the 'beat frequency', the less any interference on the display is perceived by the human eye.

Current Control Voltage Circuitry

FIG. 3 depicts an illustrative Current Control Voltage circuitry 140 in accordance with the present invention. The circuitry maps the output signal 142 of the processor, which is a PWM signal with a given duty cycle, to a DC voltage of a given level provided to input 145 of the LED matrix. The voltage produced at output 142 is inversely proportional to the duty cycle of input 145.

The PWM signal from the processor is a fixed frequency signal with a variable duty cycle. There are 1024 different duty cycles specified resulting to one of 1024 DC voltage levels at input 145. When the PWM signal has a duty cycle of 100%, the signal is always at the maximum level and the transistor 310 is turned on producing an input voltage to amplifier 330 of zero. Amplifier 330 is configured as a voltage follower so the output, and thus the input signal 145 to the LED matrix 160, is zero. Conversely, when the input signal has a 0% duty cycle, the input is zero and transistor 310 is turned off, resulting in a high voltage to amplifier 330. A high voltage is then provided at output 350 serving as input to the LED matrix. When the input PWM signal has a duty cycle between 0% and 100%, a low pass filter comprised of capacitor C3 323 and C39 325 and resistors R7 322, R2 324, and R6 319 converts the square wave into a DC voltage inversely proportional to the duty cycle. The DC voltage is provided to amplifier 330 and then to output 350.

The DC voltage applied to the amplifier 330 is limited to 227 mV. This is accomplished by using a voltage divider comprised of resistors R8 321, R7 322, R6 319, and R2 324. Each resistor results in a voltage drop from the +5 v source to ground and the voltage at the junction of resistor R6 319 and R2 324 is defined by the following equation:

$$Vcontrol(\max) = 5V \times \frac{R2}{R8+R7+R6+R2} = 5V \times \frac{10K}{10K+100K+100K+10K} = 227\text{mV}$$

The circuitry incorporates diode 340 for overvoltage protection. It is possible that hardware failures in circuit 140, such as the failure of a resistor 324 or physical contact with a probe during testing or repair, could result in higher than desirable voltages on output 350 and damage the LED matrix 160. Diode 340 allows a maximum of 650 mV to be present on output 350 which corresponds to a maximum LED current of 65 mA in the illustrated embodiment.

LED Driver Circuitry

FIG. 4 depicts an illustrative LED Driver Circuitry that can be used in connection with an LED matrix and a control unit in accordance with the present invention. The LED matrix comprises 300 LEDs in a 20×15 array. The LEDs are affixed to a circuit board approximately 3.8" by 5" in size. All the LEDs, except one, are arranged on the same side of the circuit board in a regular pattern. One LED is affixed on the back side of the circuit board and emits light in an enclosed cavity detected by a sensor. As the LEDs age or vary in temperature, the light output may change. The sensor arrangement measures the light generated by a typical LED and compensates accordingly.

The LEDs are serially connected in groups of three 440 to a transistor 410. The transistor 410 in turn is driven by an operational amplifier 400. Assuming power is provided to the LEDs, once the transistor is turned on by the amplifier 400, the current flows through the resistor 470 to ground. The current can be calculated by:

$$I_{LED}=(\text{Current_Control_Signal Voltage})/R1$$

or $$I_{LED}=(\text{Current_Control_Signal Voltage})/10\ \Omega$$

Thus, a voltage of 100 mV at the input of operational amplifier 400 allows 10 mA current through the LEDs 440. As the voltage on the operational amplifier 400 is reduced, the current through the LEDs and light emitted is reduced. Once the brightness reaches a certain level, which is 20 fL in one embodiment, the Current Control Voltage level is held constant and the PWM Control signal is modulated for further reducing the light emitted.

The LED array can be constructed of readily available components. In the illustrative embodiment, components which contained two transistors are used; each operational amplifier provides input signals to two transistors 410, 420. Those skilled in the art will appreciate that other arrangements are possible including using one operational amplifier 400 for one transistor 410, or with more than two transistors. Additionally, more or less than three LEDs could be connected in series to a transistor.

System Operation

Upon system initialization, the processor turns the backlight off to ensure a known starting condition. The system automatically determins the backlight brightness absent any manual input overriding automatic operation. The system reads the temperature sensor 170 and assuming it is safe to power up the LED matrix, the processor reads the ambient light sensor 150, calculates a desired level of brightness in fL according to a pre-determined linear equation, and sets the appropriate levels for the PWM Control signal 135 and Current Control Voltage 145. The processor reads the LED light sensor indicator 180 to determine whether the light provided is as expected, and adjusts the PWM Control signal and Current Control Voltage levels to increase or decrease the light level until the light measured by the sensor 180 is the expected value. In one embodiment, the processor increases the light by increasing the PWM Control duty cycle until 20 fL are generated. The processor then maintains a constant PWM Control duty cycle and increases the Current Control Voltage level to further increase the light level to a maximum of 200 fL. In an alternative embodiment, the processor may gradually alter the signals to the LED matrix over a few seconds to increase the light level to the desired level to avoid a sudden change in LED brightness.

In the illustrative embodiment, each PWM signal is a fixed frequency of 150 Hz, and each signal has an independently selected duty cycle, corresponding to one of 1024 discrete values. The two PWM signals are signals provided via input connections 135 and 145, processed by the PWM Control circuit and Current Control circuit respectively, and provided to the LED matrix resulting in the LED matrix generating light. The light generated by the LED is sensed by the LED light sensor 160 providing feedback to the processor for adjusting the PWM signals for achieving the desired light level. It will be appreciated by those skilled in the art of computer programming that a variety of software routines can be readily developed to accomplish this function and that a linear equation based on empirical testing can be readily determined without undue experimentation.

The operation of the illustrative embodiment is depicted in FIG. 5. At minimum brightness, the PWM signal provided by the Current Control Voltage circuit 140 is set to provide a voltage of 30 mV as depicted by a first mode of operation 510. The 30 mV signal results in 3 mA of current in the LEDs. The PWM signal 135 is set at a duty cycle of 0.1% (1/1023). At this point, the LED matrix is producing the amount of light for the minimum desired brightness. Increasing the brightness is accomplished by increasing the duty cycle of signal 135 until the desired brightness is achieved. The frequency of the PWM signal is fixed at 150 HZ to minimize interference and display flicker, and the decrease in duty cycle increases the power to the LED. Once the duty cycle has reached 100%, the mode of operation changes and is depicted by a second mode of operation 500. In the second mode, the duty cycle of the signal present at input 135 is fixed at 100% and the Current Control voltage at input 145 is increased from 30 mV to a maximum of 227 mV by decreasing the duty cycle of the signal 142. The Current Control voltage increase results in increasing the light produced by the LED matrix. Once a maximum of 227 mV is produced, the LED matrix is generating the maximum light. Depending on the age and individual LED characteristics, the processor may limit the maximum voltage to less than 227 mV since the LED matrix may generate the desired maximum amount of light at a lower voltage.

The above invention is not limited to avionics displays, but can be adapted and used for a variety of display systems for various purposes. It can be used for controlling backlight for displays in automobiles, ships, or trains; electronic equipment such as Global Positioning System (GPS) displays or stereo equipment; handheld computers such as Personal Digital Assistants (PDAs); and wireless handsets (digital cellular phones).

Many modifications and other embodiments of the invention will come to mind to one skilled in the art to which this invention pertains having the benefit of the teachings presented in the foregoing descriptions and the associated drawings. The above illustrative embodiment facilitates compatibility with existing avionics electronics. An alternative embodiment of the PWM Control Circuit 130 is shown in FIG. 6 as well as an alternative embodiment of the Current Control Voltage Circuit 140 is shown in FIG. 7. FIG. 6 eliminates transistor Q8 210 of FIG. 2 as well as other components in the PWM Control Circuit by directly connecting the signal 605 from the processor 120 to the input 615 of the FET driver 620. The PWM signal is not inverted as in FIG. 2, but use of this circuit requires minor modification to the software in the processor 120 for setting the duty cycle to achieve the same control signal values provided to the LED matrix 160. FIG. 7 illustrates an alternative embodiment avoiding the use of transistor Q1 310 and resistor R8 322 of FIG. 3 by altering the value of R7 722. The PWM signal 742 is not inverted prior to processing by amplifier 730 as in FIG. 3, but use of this circuit requires minor modification to the software executing in the processor 120 to achieve the same control signal values to the LED matrix 160.

Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A system for controlling the brightness of an avionics display, comprising:

a LED matrix comprising a plurality of light emitting diodes operatively connected to receive a pulse width modulated control signal and a current control voltage signal;

a sensor operatively connected with a processor, wherein said sensor detects light emitted by said LED matrix and generates in response thereto an input signal;

the processor that receives said input signal and provides a first output digital signal and a second output digital signal based at least in part on said input signal;

a pulse width modulator circuit, wherein said pulse width modulator circuit receives said first output digital signal and generates said pulse width modulated control signal of a given duty cycle based on said first output digital signal; and current control circuit, wherein said current control circuit receives said second output digital signal and generates said current control voltage signal based on said second output digital signal.

2. The system of claim 1 wherein said processor further receives a second input signal indicative of ambient light levels relative to said avionics display, and wherein said first output digital signal and said second output digital signal are based at least in part on said second input signal.

3. The system of claim 2 wherein said processor further receives a third input signal indicative of temperature levels relative to said avionics display, and wherein said first output digital signal and said second output digital signal are based at least in part on said third input signal.

4. The system of claim 1 wherein said pulse width modulator circuit comprises a resistor and a capacitor that operate to slow rise and fall times associated with said pulse width modulated control signal.

5. The system of claim 1 wherein said pulse width modulator control signal is of a frequency minimizing interference with a vertical synchronous refresh frequency of said avionics display.

6. The system of claim 1 wherein said first output digital signal is a pulse width modulated signal and said second output digital signal is a pulse width modulated signal.

7. A method of controlling the brightness of an avionics display comprising a plurality of LEDs operating in an aircraft cockpit, the method comprising:

detecting light generated by at least one of said plurality of LEDs;

determining a pulse width modulated wave control signal having a given duty cycle and a current control voltage signal having a given voltage level to control at least partially light generated by said plurality of LEDs; and adjusting one or both of said duty cycle of said pulse width modulated wave and said voltage level of said current control voltage signal based on the light detected in the detecting step to be generated from said one of said plurality of LEDs.

8. The method according to claim 7 wherein adjusting is based at least in part on backlight ambient temperature level.

9. The method according to claim 7 wherein adjusting said duty cycle or said current control voltage level is based on at least in part on ambient light level.

10. An apparatus for controlling the brightness of an LED matrix providing backlight to an avionics display operating in an aircraft cockpit, comprising:

a sensor for detecting an amount of light emitted by said LED matrix and generating an input signal based thereon;

a processor that receives said input signal and that provides a first output digital signal and a second output digital signal based on said input signal;

a pulse width modulator controller that receives said first output digital signal and provides a pulse width modulated control signal wherein said pulse width modulated control signal is of a fixed periodic frequency and having a duty cycle based on said first output digital signal; and a current controller that receives said second output digital signal and provides a current control voltage signal based on said input signal.

11. The apparatus of claim 10 wherein said processor means receives a second input signal, wherein said second input signal is related to ambient light conditions of the aircraft cockpit.

12. The apparatus of claim 10 wherein said processor means receives a third input signal, wherein said third input signal is related to a temperature of said LED matrix.

13. The apparatus of claim 10 wherein said pulse width modulated control signal is of a frequency minimizing interference with the vertical synchronous refresh rate of said display.

14. An apparatus for controlling the brightness of an LED matrix, comprising:

an LED matrix that receives a brightness control signal and comprises a plurality of light-emitting-diodes arranged in a planar array affixed to a substrate with a first side and a second side where substantially all of the LEDs are affixed to said first side of said substrate and the remaining LEDs are affixed to said second side of said substrate; a sensor that detects light generated by said LEDs to said second side of said substrate and generates an input signal; and a control unit that receives said input signal and provides said brightness control signal based on at least in part on said input signal.

15. The apparatus of claim 14 wherein the control unit provides a brightness control signal comprising a pulse width modulated signal.

16. The apparatus of claim 14 wherein the control unit provides a brightness control signal having a DC voltage level.

17. A system for backlighting a display in the presence of ambient light, comprising:

a first sensor arranged to sense the ambient light, and generating a first light intensity signal based thereon;

a second sensor arranged to sense intensity of light used to backlight the display, and generating a second light intensity signal based thereon;

a controller operatively connected to receive the first and second light intensity signals from said first and second sensors, respectively, and generating at least one control signal based on the first and second intensity signals; and a light source matrix comprising a plurality of LEDs arranged proximate to the display and operatively connected to receive at least one intensity control signal, said light source matrix generating the light used to backlight the display based on the control signal.

* * * * *